US007302878B2

(12) United States Patent
Chang

(10) Patent No.: US 7,302,878 B2
(45) Date of Patent: Dec. 4, 2007

(54) PROTECTIVE COVER DEVICE FOR A SAWING MACHINE

(75) Inventor: Yueh-Hsun Chang, Nan-Tou Hsien (TW)

(73) Assignee: P & F Brother Industrial Corporation, Taichung (TW)

( * ) Notice: Subject to any disclaimer, the term of this patent is extended or adjusted under 35 U.S.C. 154(b) by 190 days.

(21) Appl. No.: 11/134,788

(22) Filed: May 21, 2005

(65) Prior Publication Data

US 2006/0260456 A1 Nov. 23, 2006

(51) Int. Cl.
*B27G 19/08* (2006.01)

(52) U.S. Cl. ..... 83/102.1; 83/477.2; 83/478; 83/DIG. 1

(58) Field of Classification Search ..... 83/102, 83/102.1, 103–107, 477.2, 478, 483, DIG. 1; 30/371, 102, 102.1, 103–107, 477.2, 478, 30/483; 144/182–184, 40
See application file for complete search history.

(56) References Cited

U.S. PATENT DOCUMENTS 2,593,596 A * 4/1952 Olson ..... 83/102.1
4,615,247 A * 10/1986 Berkeley ..... 83/102.1
4,625,604 A * 12/1986 Handler et al. ..... 83/102.1
6,405,624 B2 * 6/2002 Sutton ..... 83/102.1
6,840,144 B2 * 1/2005 Huang ..... 83/102.1
7,137,327 B2 * 11/2006 Garcia et al. ..... 83/102.1
2005/0211034 A1 * 9/2005 Sasaki et al. ..... 83/102.1

* cited by examiner

*Primary Examiner*—Kenneth E. Peterson
*Assistant Examiner*—Phong Nguyen
(74) *Attorney, Agent, or Firm*—Christie, Parker & Hale, LLP

(57) ABSTRACT

A protective cover device includes a supporting member secured to a worktable of a sawing machine, a cantilever having rear and front pivot ends pivoted to the supporting member and a cover shield by rear and front journal pins, respectively. At least one of the rear and front journal pins is movable relative to a corresponding one of the rear and front pivot ends between a latched position, where a respective one of the rear and front journal pins pivotally secures a corresponding one of the rear and front pivot ends to a corresponding one of the supporting member and the cover shield, and a released position, where the respective one of the rear and front journal pins is clear of the corresponding one of the supporting member and the front pivot end by being withdrawn therefrom.

11 Claims, 16 Drawing Sheets

PROTECTIVE COVER DEVICE FOR A SAWING MACHINE

BACKGROUND OF THE INVENTION

1. Field of the Invention

This invention relates to a protective cover device, more particularly to a protective cover device adapted to be mounted on a worktable of a sawing machine on which a workpiece is fed so as to cover a cutting blade of the sawing machine.

2. Description of the Related Art

Referring to FIG. 1, a conventional protective cover device 10 is shown to include a supporting member 11, a cover shield 12, and a parallel linkage 13. The supporting member 11 has a lower end 112 secured on a worktable of a sawing machine (not shown). The cover shield 12 defines an accommodation space 121 configured to cover a circular saw blade (not shown) of the sawing machine. The parallel linkage 13 includes two parallel levers 131, 132, each pivoted to the cover shield 12 and an upper end 111 of the supporting member 11 so as to permit turning of the cover shield 12 relative to the supporting member 11.

Although the cover shield 12 can be moved to cover the saw blade for protecting the operator from flying wood shavings during sawing operation, the cover shield 12 is not detachable from the supporting member 11 and may therefore interfere with the replacement of the saw blade.

SUMMARY OF THE INVENTION

The object of the present invention is to provide a protective cover device which is detachably assembled to a worktable of a sawing machine so as to facilitate replacement of a saw blade on the machine.

According to this invention, the protective cover device includes a supporting member having a lower end portion which is adapted to be secured on a worktable of a sawing machine, and an upper end portion which is opposite to the lower end portion in an upright direction and which has a rear pivot hole extending therethrough in a transverse direction. A cantilever has front and rear pivot ends opposite to each other in a longitudinal direction such that a rear journal pin extends into the rear pivot hole to pivotally secure the rear pivot end to the upper end portion. Thus, the rear pivot end is turnable between a lifted position where the front pivot end is remote from the upper end portion, and a working position where the front pivot end is closer to the upper end portion. A cover shield is adapted to cover a cutting blade of the sawing machine, and includes front and rear ends opposite to each other in the longitudinal direction, and a middle portion interposed therebetween. The front end extends downwards to terminate at a nose edge. The middle portion has a front pivot hole extending in the transverse direction such that a front journal pin extends into the front pivot hole and the front pivot end of the cantilever to pivotally secure the middle portion to the front pivot end of the cantilever. Thus, the nose edge is brought to be in sliding contact with an upper surface of a workpiece on the worktable by virtue of gravity when the rear pivot end is in the working position. At least one of the rear and front journal pins is movable relative to a corresponding one of the rear and front pivot ends in the transverse direction between a latched position, where a respective one of the rear and front journal pins pivotally secures a corresponding one of the rear and front pivot ends to a corresponding one of the upper end portion and the middle portion by extending into a corresponding one of the rear and front pivot holes, and a released position, where the respective one of the rear and front journal pins is clear of the corresponding one of the rear pivot hole and the front pivot end by being withdrawn therefrom in the transverse direction.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
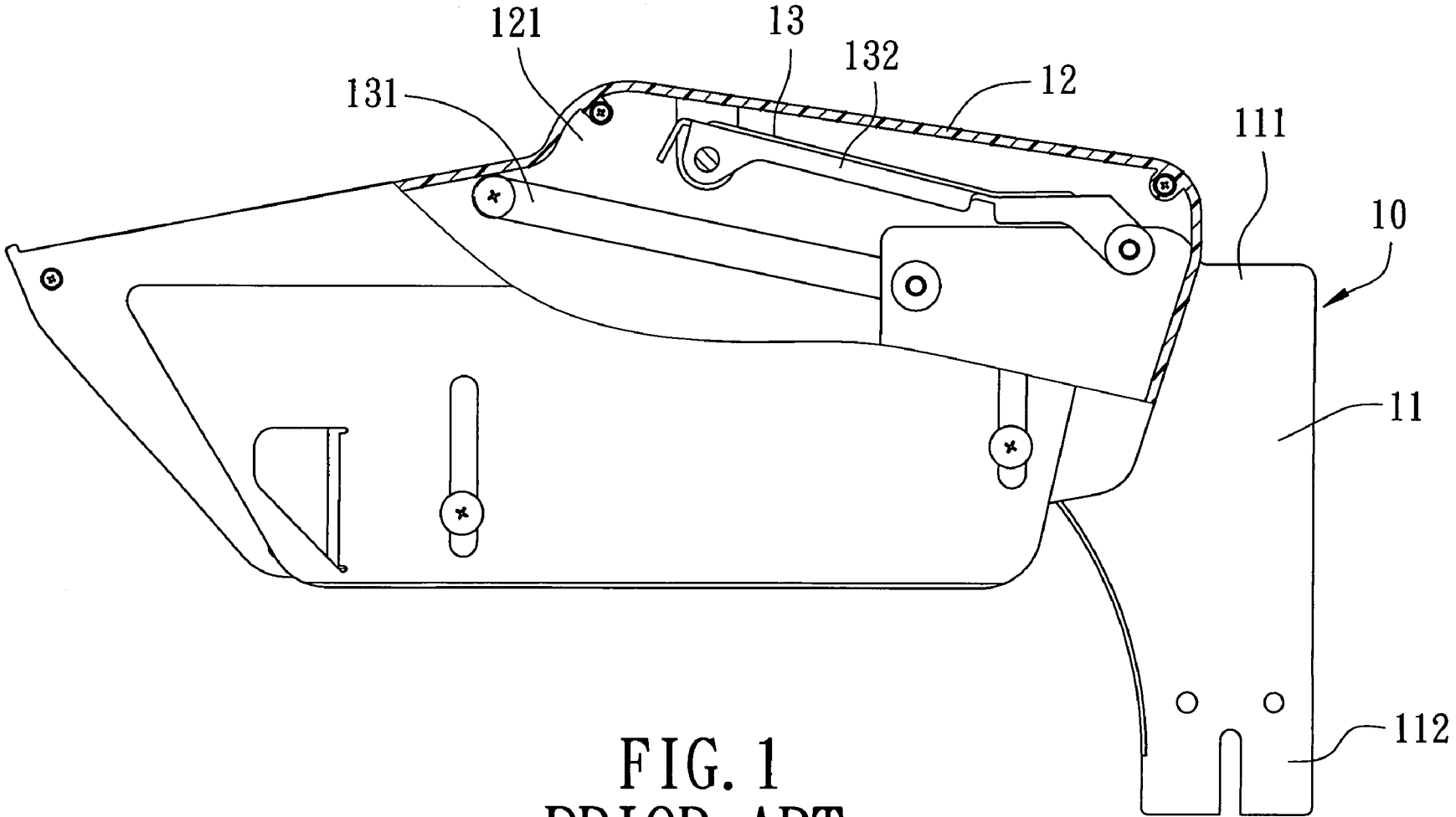
FIG. 1 PRIOR ART
FIG. 1 is a schematic view of a conventional protective cover device.
Figure 2:
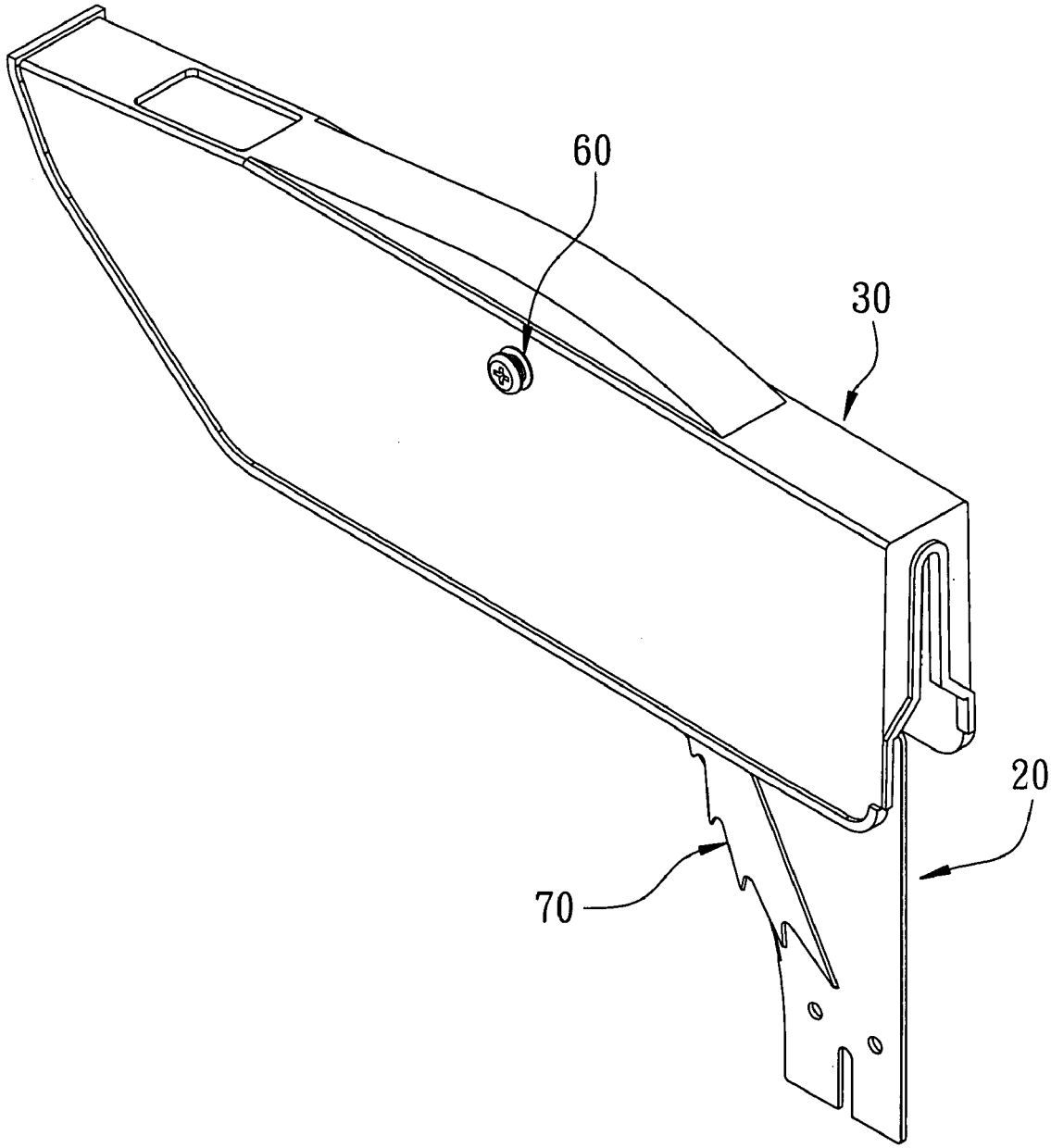
FIG. 2 is a perspective view of the preferred embodiment of a protective cover device according to this invention.
Figure 3:
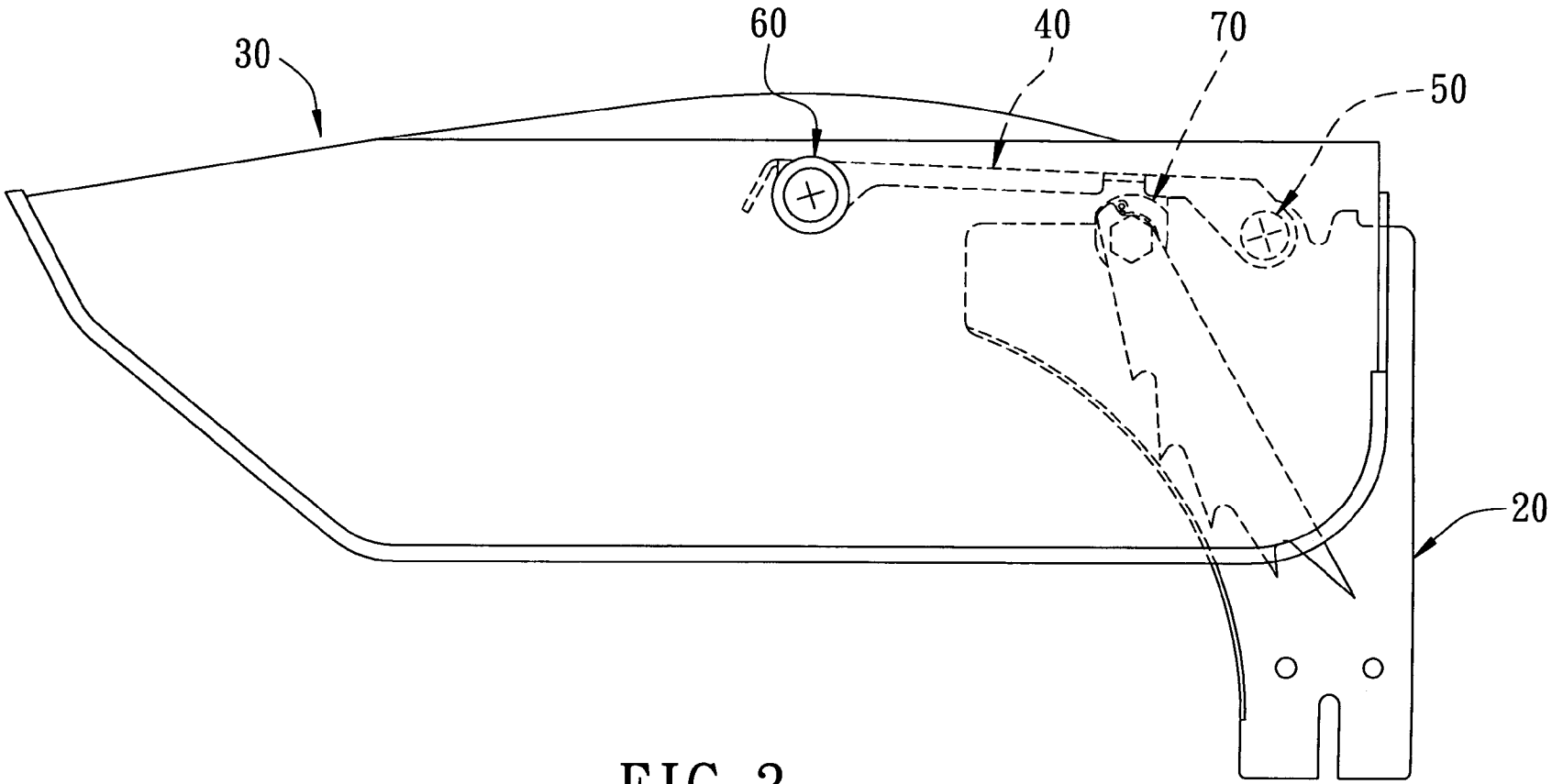
FIG. 3 is a schematic view of the preferred embodiment.
Figure 4:
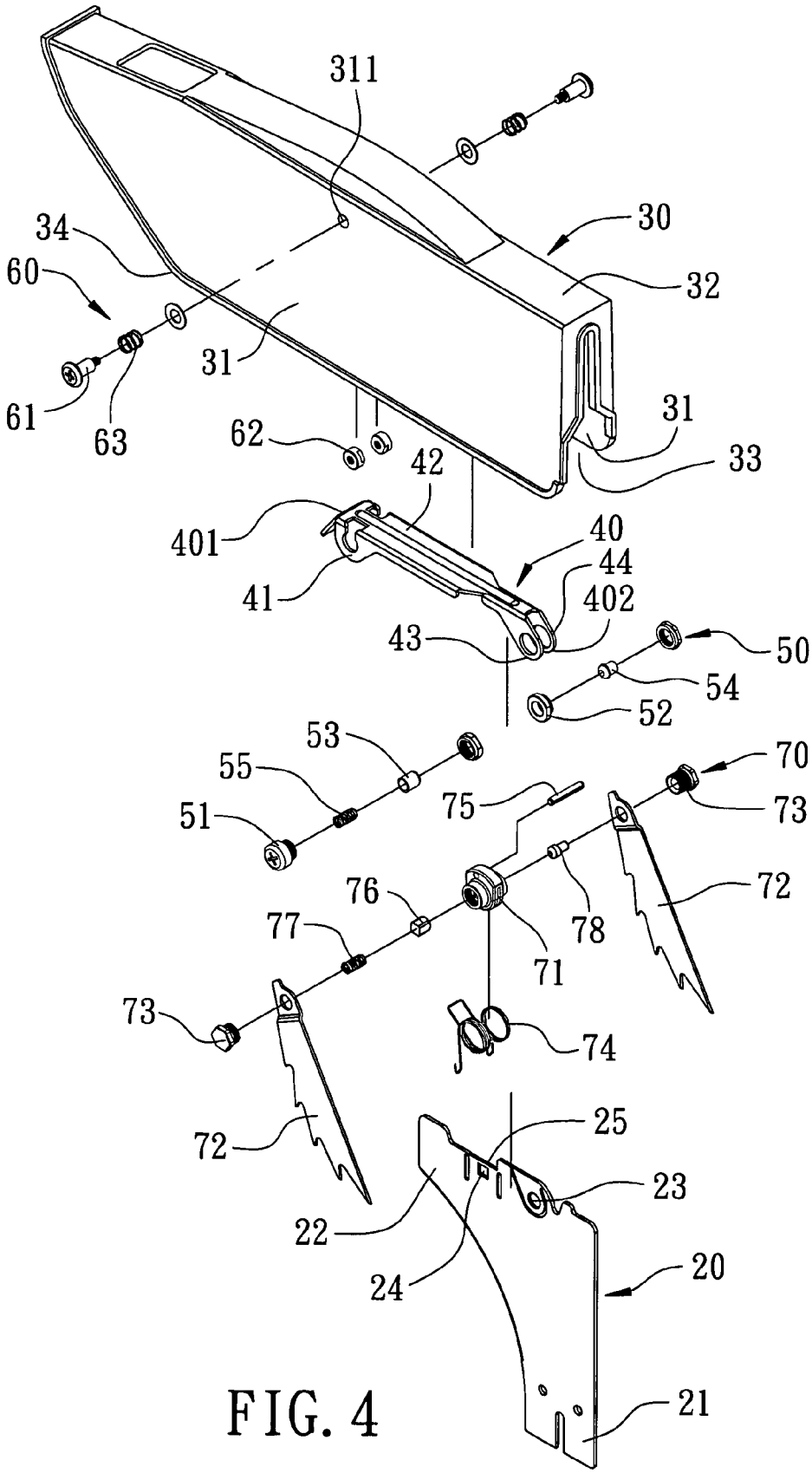
FIG. 4 is an exploded perspective view of the preferred embodiment.

Referring to FIGS. 2 to 4, the preferred embodiment of a protective cover device according to the present invention is adapted to be mounted on a worktable of a sawing machine (not shown) on which a workpiece (not shown) is fed along a working path in a longitudinal direction, and is shown to comprise a supporting member 20, a cantilever 40, a cover shield 30, a rear journal unit 50, a front journal unit 60, and a hold-down unit 70.

The supporting member 20 is in the form of a flat plate, and has a lower end portion 21 which is adapted to be secured on the worktable of the sawing machine, and an upper end portion 22 which is opposite to the lower end portion 21 in an upright direction transverse to the longitudinal direction and which has a rear pivot hole 23 and a retaining hole 24 extending therethrough in a transverse direction relative to both the upright direction and the longitudinal direction, and a retaining edge 25 disposed upwardly of the retaining hole 24. The rear pivot hole 23 is round, and the retaining hole 24 is rectangular.

Figure 5:
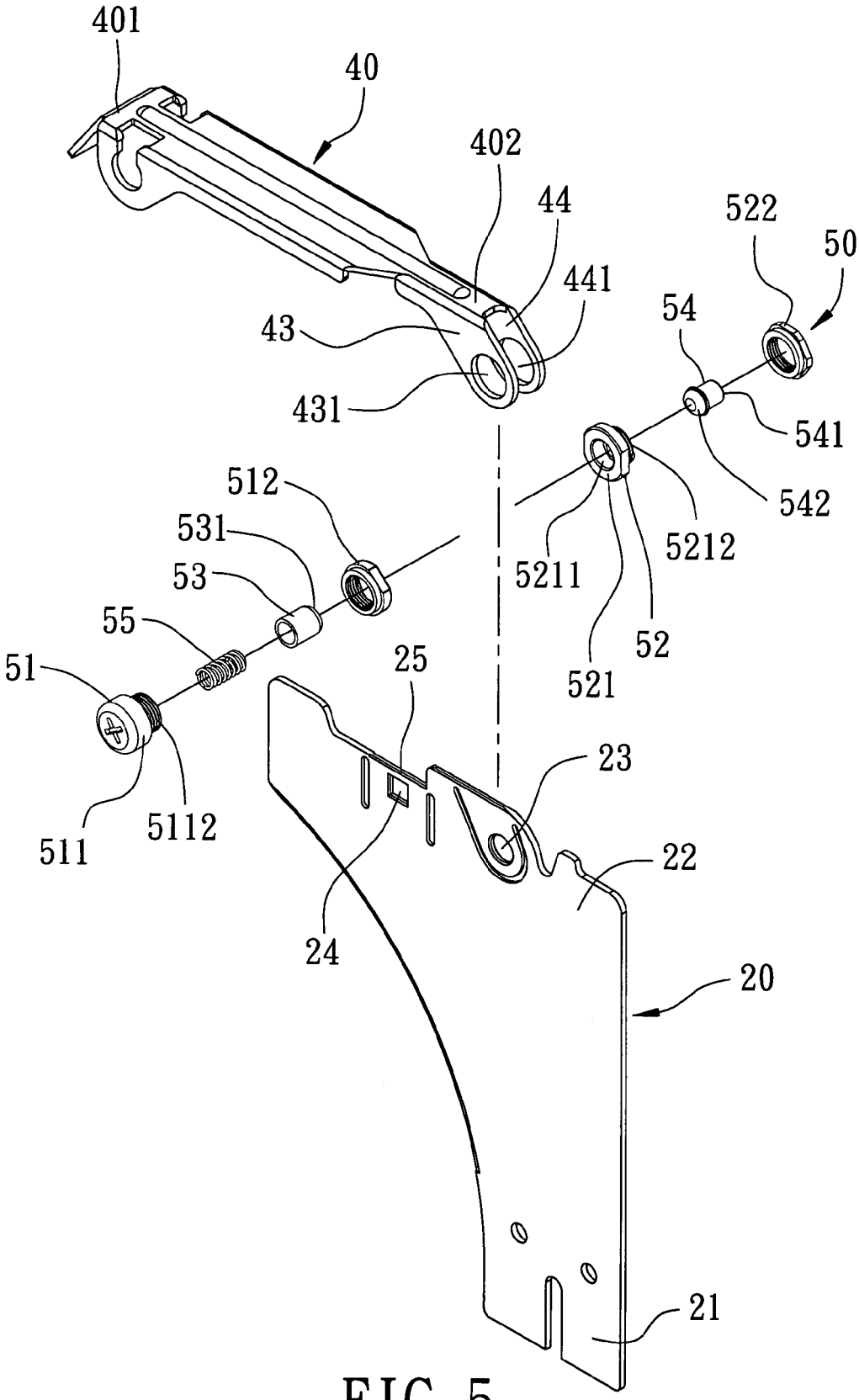
FIG. 5 is an exploded perspective view of the preferred embodiment in part.
Figure 6:
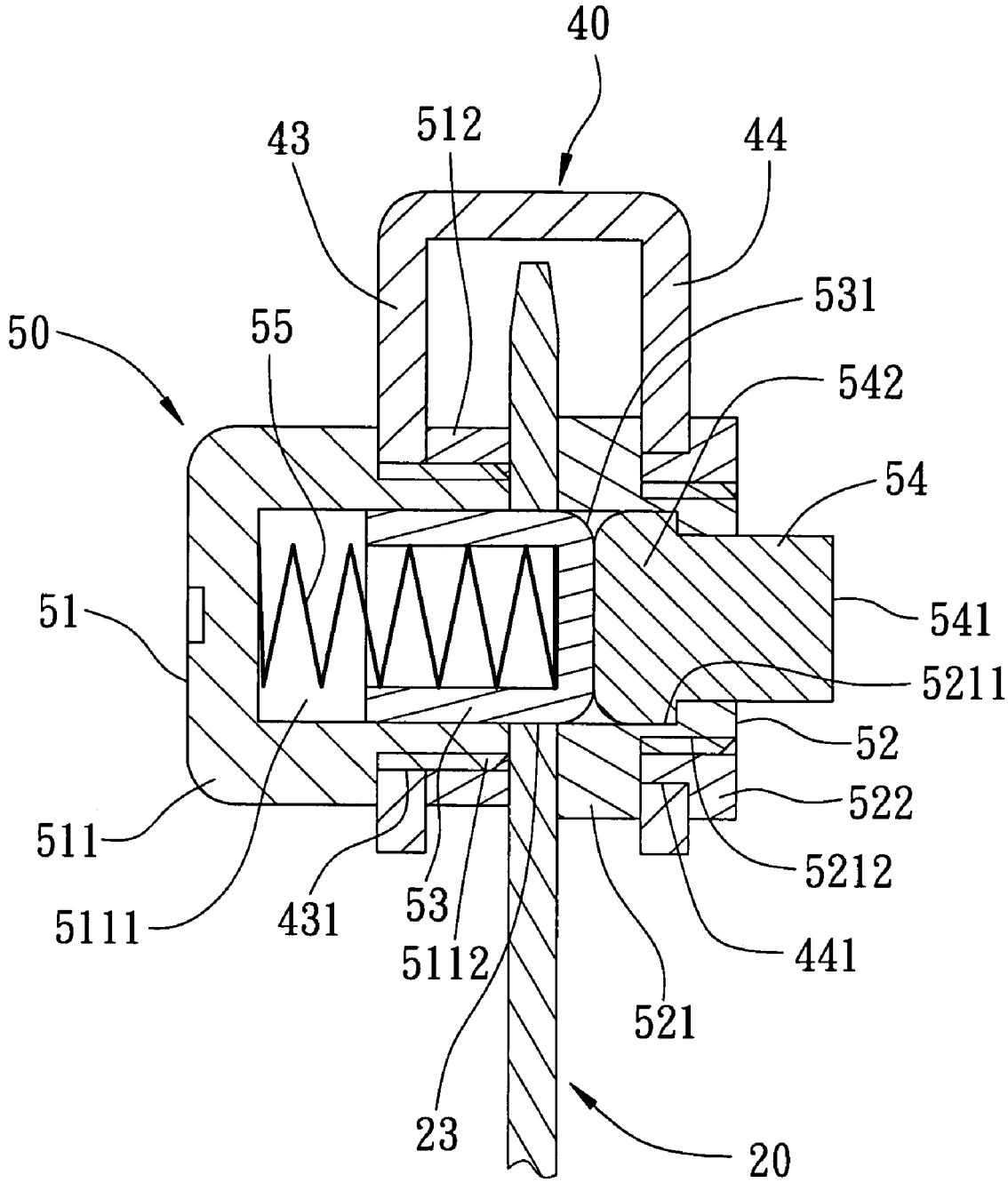
FIG. 6 is a fragmentary assembled sectional view of the preferred embodiment shown in FIG. 5, showing a rear journal pin in a latched position.

The cantilever 40 has front and rear pivot ends 401,402 opposite to each other in the longitudinal direction. With further reference to FIGS. 5 and 6, the rear pivot end 402 includes left and right lugs 43,44 which are spaced apart from each other in the transverse direction so as to define an accommodation space for receiving the upper end portion 22 of the supporting member 20 therein, and which respectively have left and right through holes 431,441.

The rear journal unit 50 includes a first guiding member 51, a second guiding member 52, a rear journal pin 53, a rear push actuator 54, and a biasing member 55. The first guiding member 51 includes a left stem 5112 which is configured to pass through the left through hole 431, which has an inserting bore 5111 extending along a rear axis in the transverse direction to be exposed to the accommodation space between the lugs 43,44, and which has a left outer threaded surface that surrounds the rear axis and that is threadedly engaged with a left tightening member 512, and a left enlarged head 511 which extends leftwards from the left stem 5112 and outwardly of the left through hole 431, and which forms, in cooperation with the left stem 5112, a left surrounding shoulder to abut against the left lug 43 so as to be secured to the left lug 43.

The second guiding member 52 includes a right stem 5212 which is disposed in and which extends rightwards and outwardly of the right through hole 441, and a right enlarged head 521 which extends leftwards from the right stem 5212 into the accommodation space between the lugs 43, 44, and which forms, in cooperation with the right stem 5212, a right surrounding shoulder. The right stem 5212 has a right outer threaded surface which surrounds the rear axis and which is threadedly engaged with a right tightening member 522 so as to permit the right surrounding shoulder to be brought to abut against the right lug 44 so as to be secured to the right lug 44. The right enlarged head 521 has a guiding bore 5211 which extends along the rear axis to communicate with the inserting bore 5111.

The rear journal pin 53 is received in and is guided to move into the inserting bore 5111, and has an actuated end 531 which can extend through the rear pivot hole 23 to pivotally secure the rear pivot end 402 of the cantilever 40 to the upper end portion 22 of the supporting member 20, as shown in FIG. 6, such that the rear pivot end 402 is turnable about the rear axis between a lifted position where the front pivot end 401 is remote from the upper end portion 22, and a working position where the front pivot end 401 is closer to the upper end portion 22.

The biasing member 55 is disposed in the inserting bore 5111 between the left enlarged head 511 and the actuated end 531 of the rear journal pin 53 to bias the actuated end 531 to a latched position, where the actuated end 531 extends through the rear pivot hole 23 so as to pivotally secure the rear pivot end 402 to the upper end portion 22.

Figure 7:
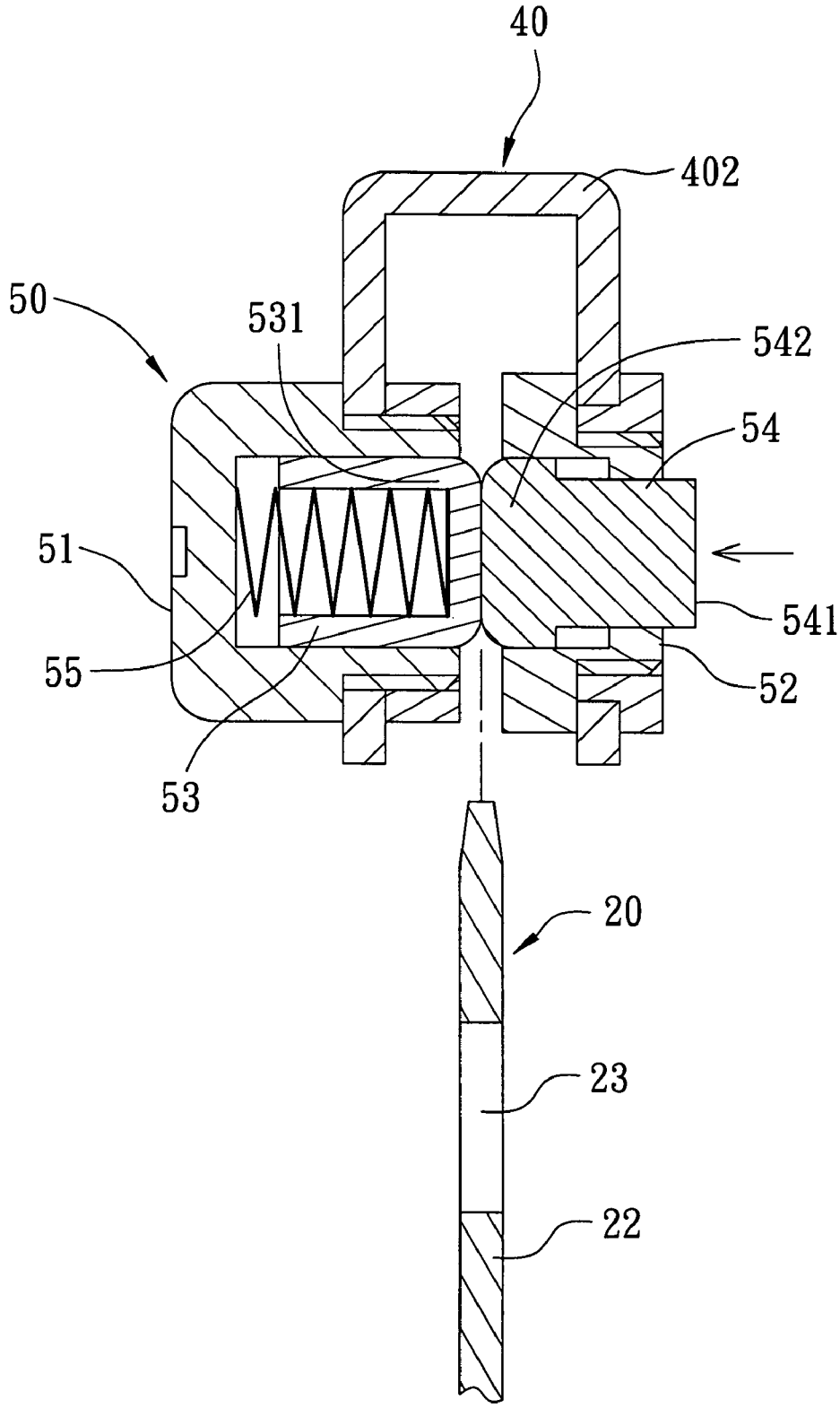
FIG. 7 is a fragmentary sectional view similar to FIG. 6, showing how a cantilever is detached from a supporting member.
Figure 8:
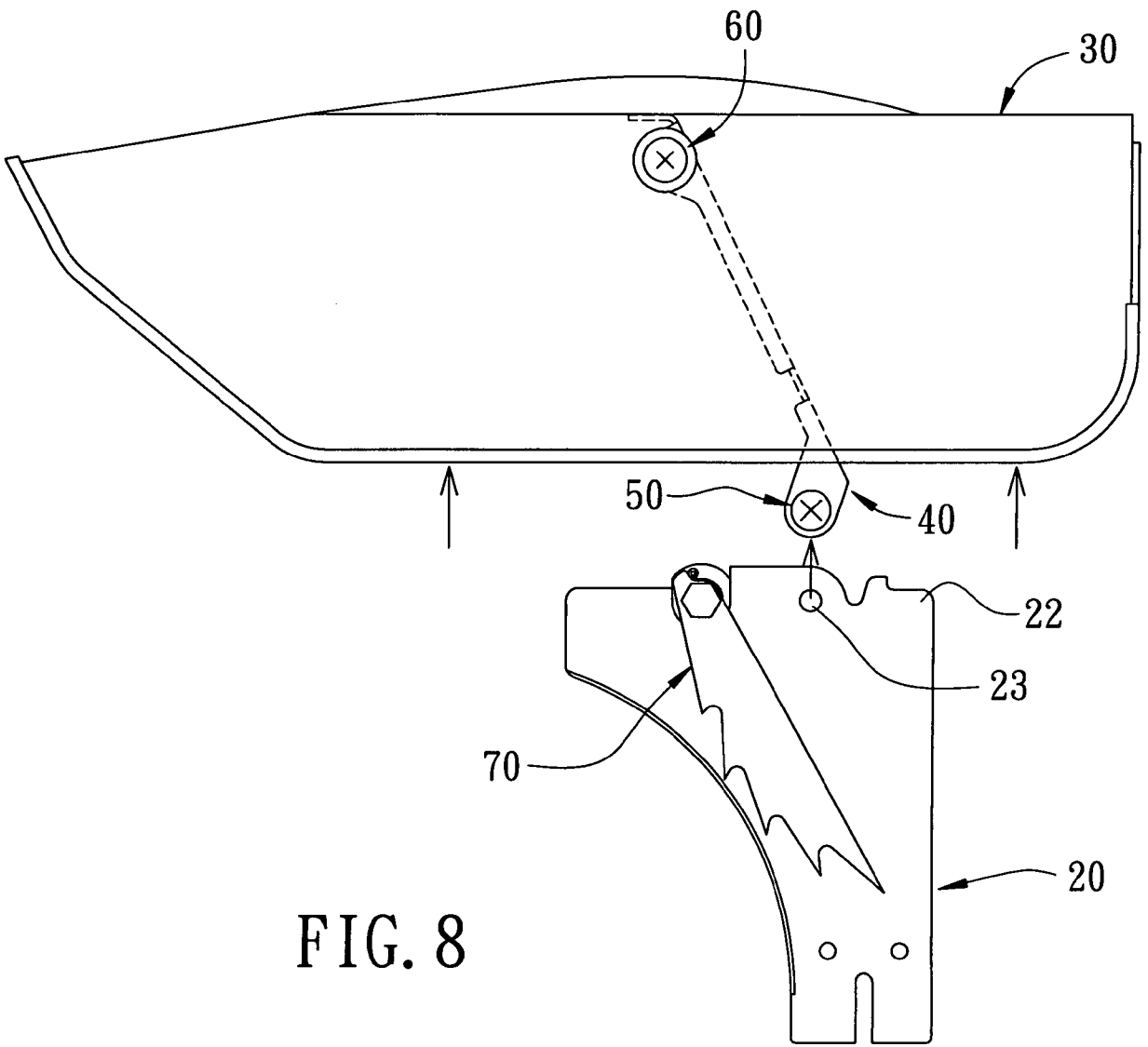
FIG. 8 is a schematic view of the preferred embodiment, showing the cantilever is detached from the supporting member.

The rear push actuator 54 has an actuating end 542 which confronts the actuated end 531 of the rear journal pin 53, and an operated end 541 which extends outwardly of the guiding bore 5211 and which is pushed to move the actuating end 542 in the transverse direction so as to push the actuated end 531 of the rear journal pin 53 along the rear axis against the biasing action of the biasing member 55 to a released position, where the actuated end 531 is clear of the rear pivot hole 23, thereby permitting separation of the rear pivot end 402 of the cantilever 40 from the upper end portion 22 of the supporting member 20, as shown in FIGS. 7 and 8.

Preferably, each of the actuated end 531 of the rear journal pin 53 and the actuating end 542 of the rear push actuator 54 has a round edge so as to facilitate movement of the rear pivot end 402 upwards and away from the upper end portion 22 while the actuated end 531 is kept in contact with the actuating end 542 by the biasing action of the biasing member 55 in the released position.

Referring once again to FIG. 4, the cover shield 30 is configured to be adapted to cover a cutting blade (not shown) of the sawing machine, and includes two side plates 31 which are spaced apart from each other in the transverse direction to define a mounting space 33 for receiving the cantilever 40 therein, and a top wall 32 interconnecting the side plates 31. Each of the side plates 31 includes front and rear ends opposite to each other in the longitudinal direction, and a middle portion interposed therebetween. The front end extends downwards to terminate at a nose edge 34. The middle portion has a front pivot hole 311 which extends therethrough in the transverse direction. Thus, the cover shield 30 is movable by the cantilever 40 so as to be detached from the supporting member 20 when the rear pivot end 402 of the cantilever 40 is separated from the upper end portion 22 of the supporting member 20, as shown in FIG. 8.

Figure 9:
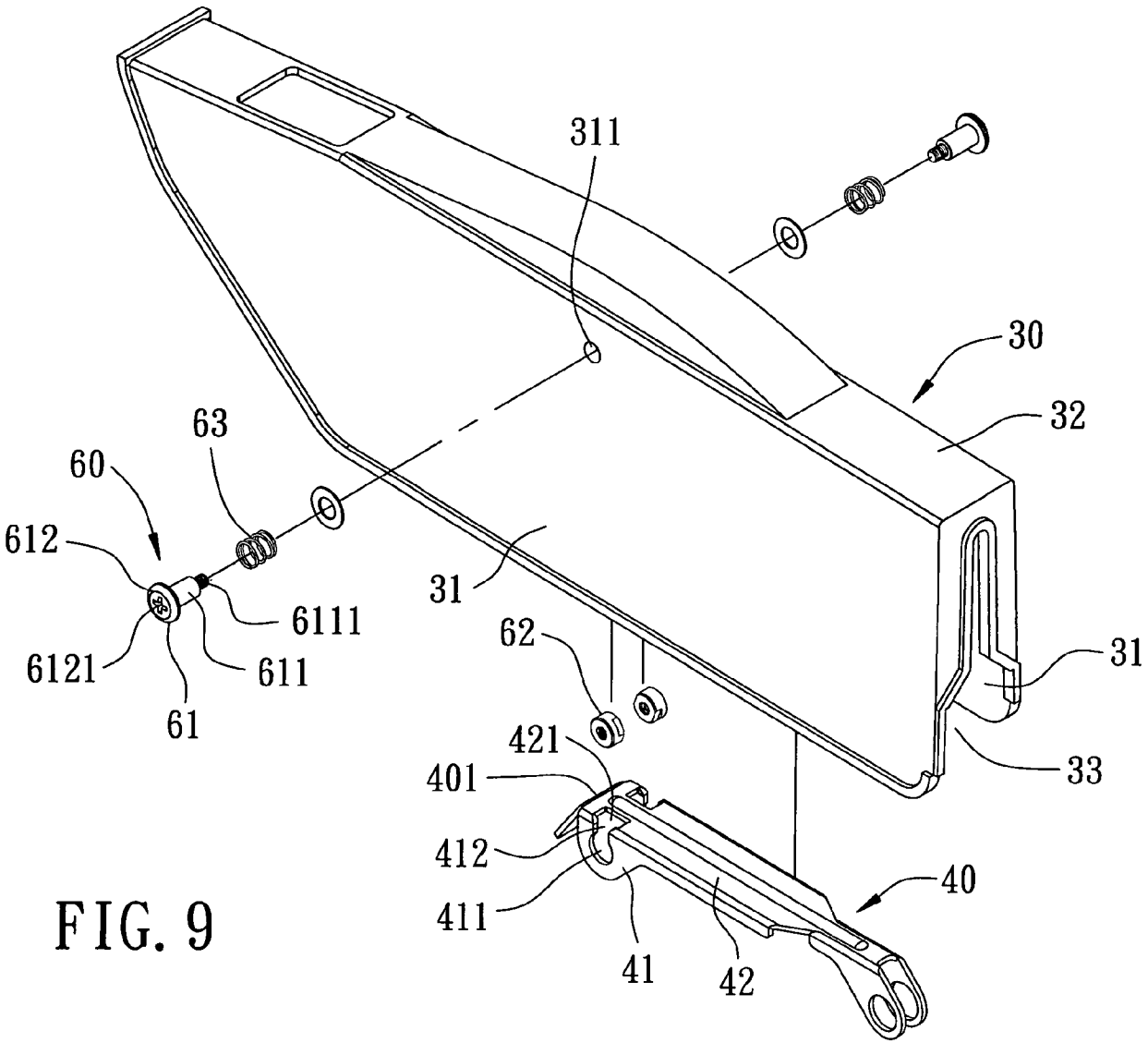
FIG. 9 is an exploded perspective view of the preferred embodiment in part.
Figure 10:
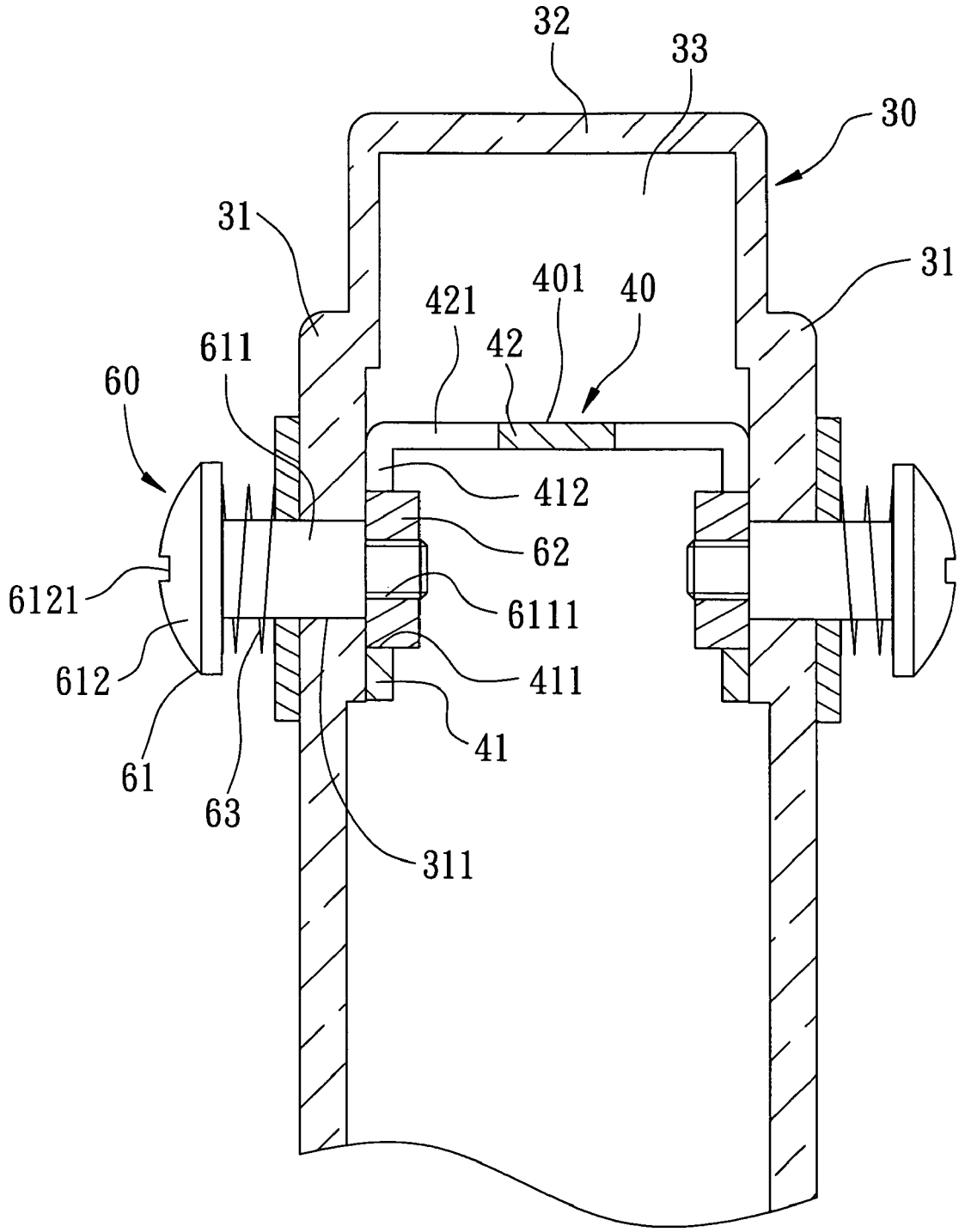
FIG. 10 is a fragmentary assembled sectional view of the preferred embodiment shown in FIG. 9, showing a front journal pin in a latched position.

Further, referring to FIGS. 9 and 10, the front pivot end 401 of the cantilever 40 includes two lugs 41 which are spaced apart from each other in the transverse direction, and an upper wall 42 which interconnects the lugs 41. Each of the lugs 41 has a through hole 411 extending in the transverse direction, and a releasing hole 421 which extends in the upright direction and which is communicated with the through hole 411 by a communicating slot 412 to form an integral opening.

The front journal unit 60 includes a front journal pin with two journal shafts 61 and two screw nuts 62, and two biasing members 63. Each of the journal shafts 61 has a shank 611 which extends through the respective front pivot hole 311 to pivotally secure the middle portions of the side plats 31 of the cover shield 30 to the front pivot end 401 of the cantilever 40 such that the nose edges 34 of the cover shield 30 are brought to be in sliding contact with an upper surface of the workpiece fed along the working path by virtue of gravity when the rear pivot end 402 is in the working position. The shank 611 terminates at a connecting end 6111 which is threadedly engaged with the respective screw nut 62. The journal shaft 61 further has an operated end 612 which is opposite to the connecting end 6111 and which is disposed outwardly of the respective side plate 31. An operated slot 6121 is formed in the operated end 612 to receive a hand tool (not shown) used to fasten the connecting end 6111 and the screw nut 62. Each of the biasing members 63 is sleeved on the shank 611 of the respective journal shaft 61 between the operated end 612 and the respective side plate 31. By virtue of the threaded engagement between the screw nut 62 and the connecting end 6111 against the biasing action of the respective biasing member 63, each screw nut 62 is brought to abut against the respective side plate 31 so as to be retained in the respective through hole 411, thereby placing the respective journal shaft 61 in a latched position by the biasing action of the respective biasing member 63, as shown in FIG. 10.

Figure 11:
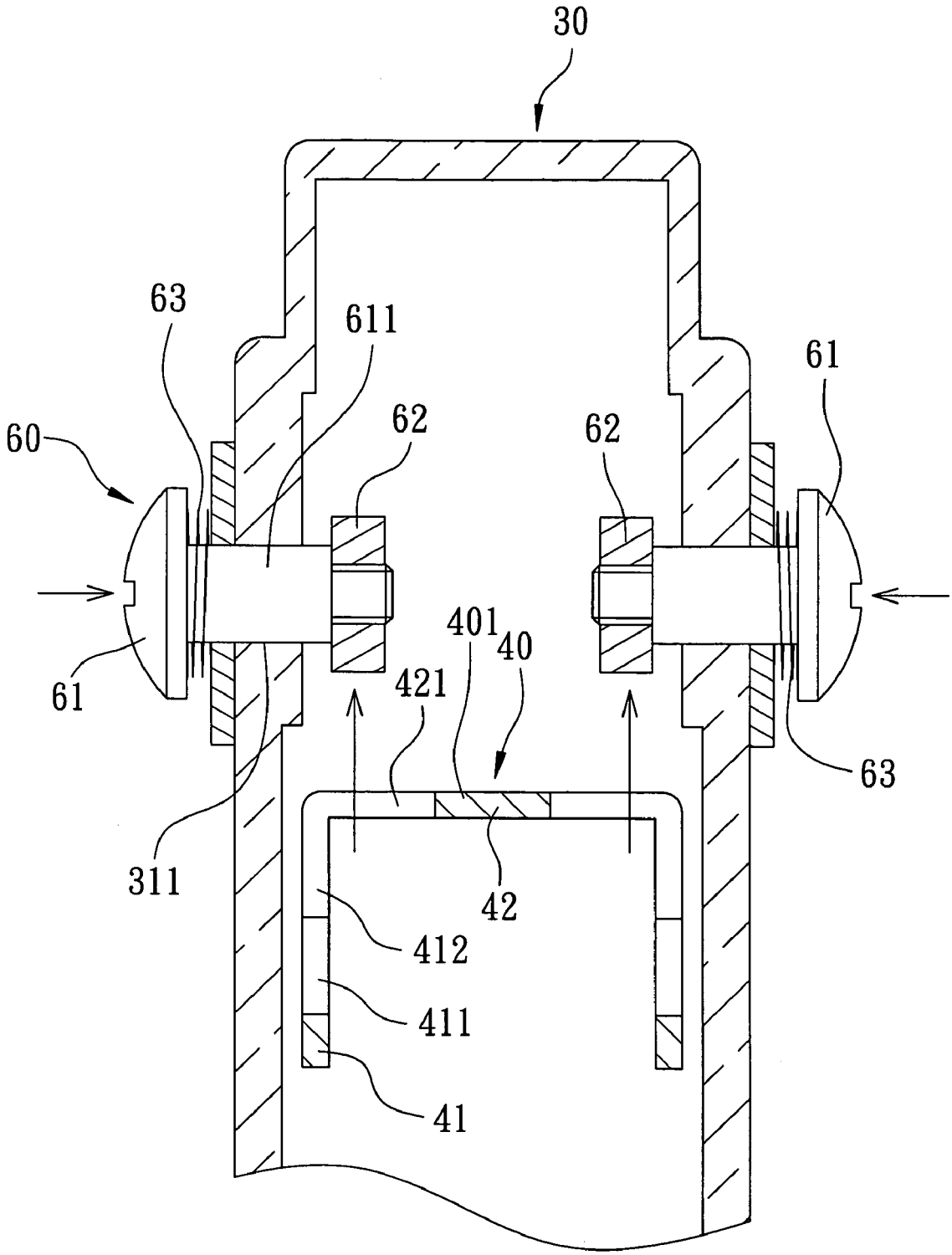
FIG. 11 is a fragmentary sectional view similar to FIG. 10, showing how a cover shield is detached from the cantilever.
Figure 12:
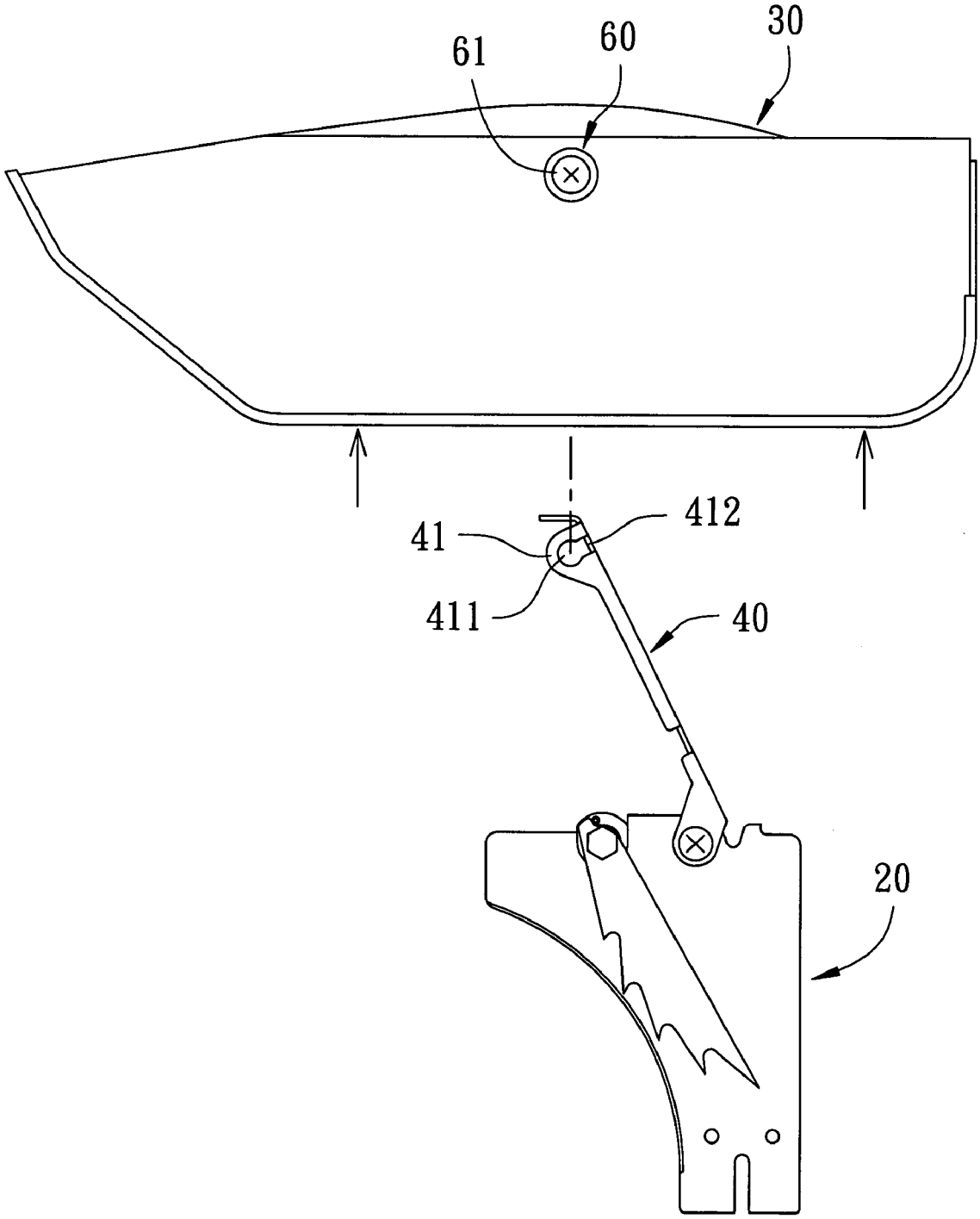
FIG. 12 is a schematic view of the preferred embodiment showing that the cover shield is detached from the cantilever.

As shown in FIG. 11, when the operated end 612 is pressed against the biasing action of the respective biasing member 63, the connecting end 6111 and the screw nut 62 are withdrawn inwardly to be clear of the respective through hole 411 so as to be moved to a released position, thereby permitting lifting of the cover shield 30 away from the lugs 41 in the upright direction, as shown in FIG. 12.

Figure 13:
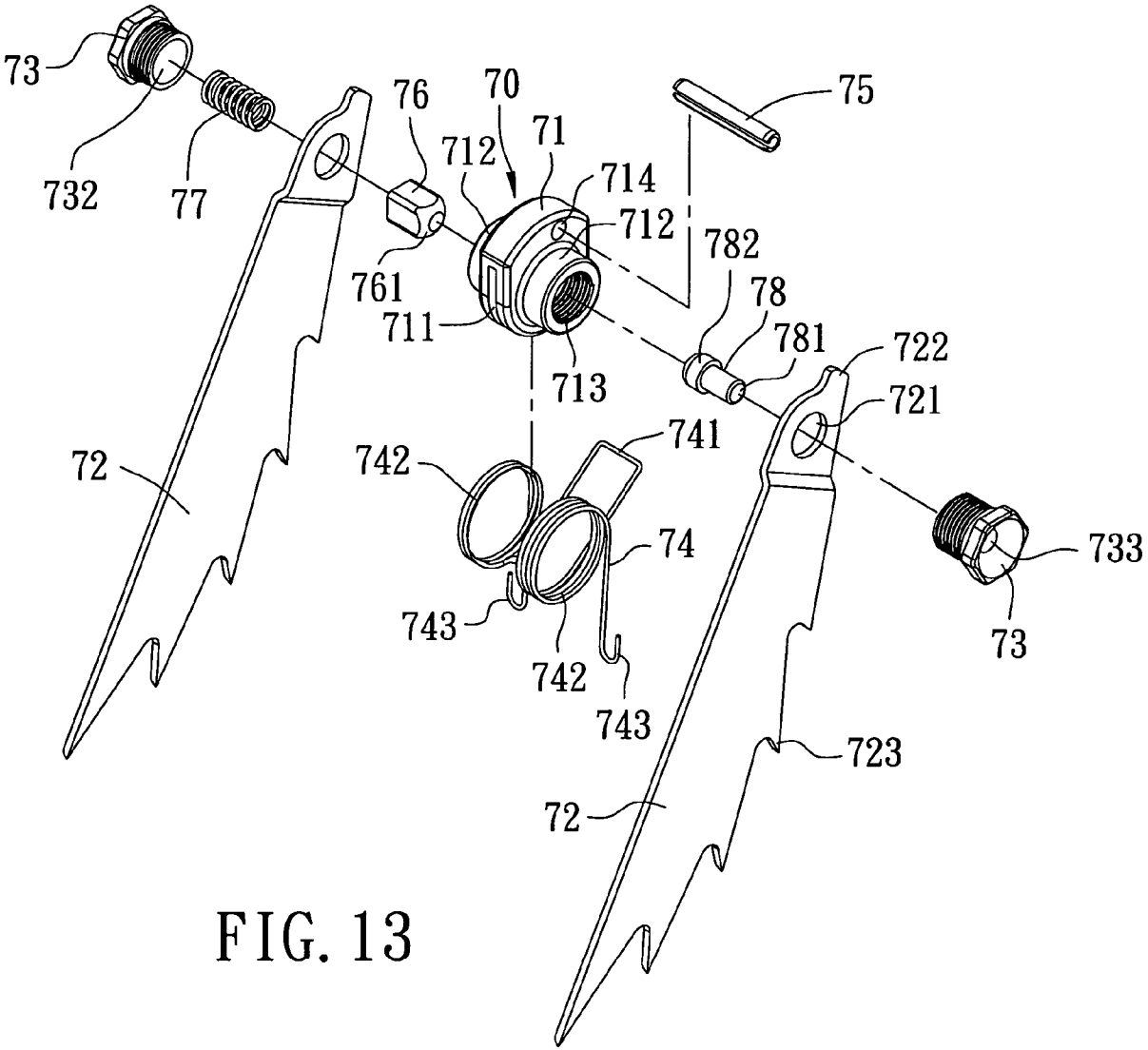
FIG. 13 is an exploded perspective view of the preferred embodiment in part.
Figure 14:
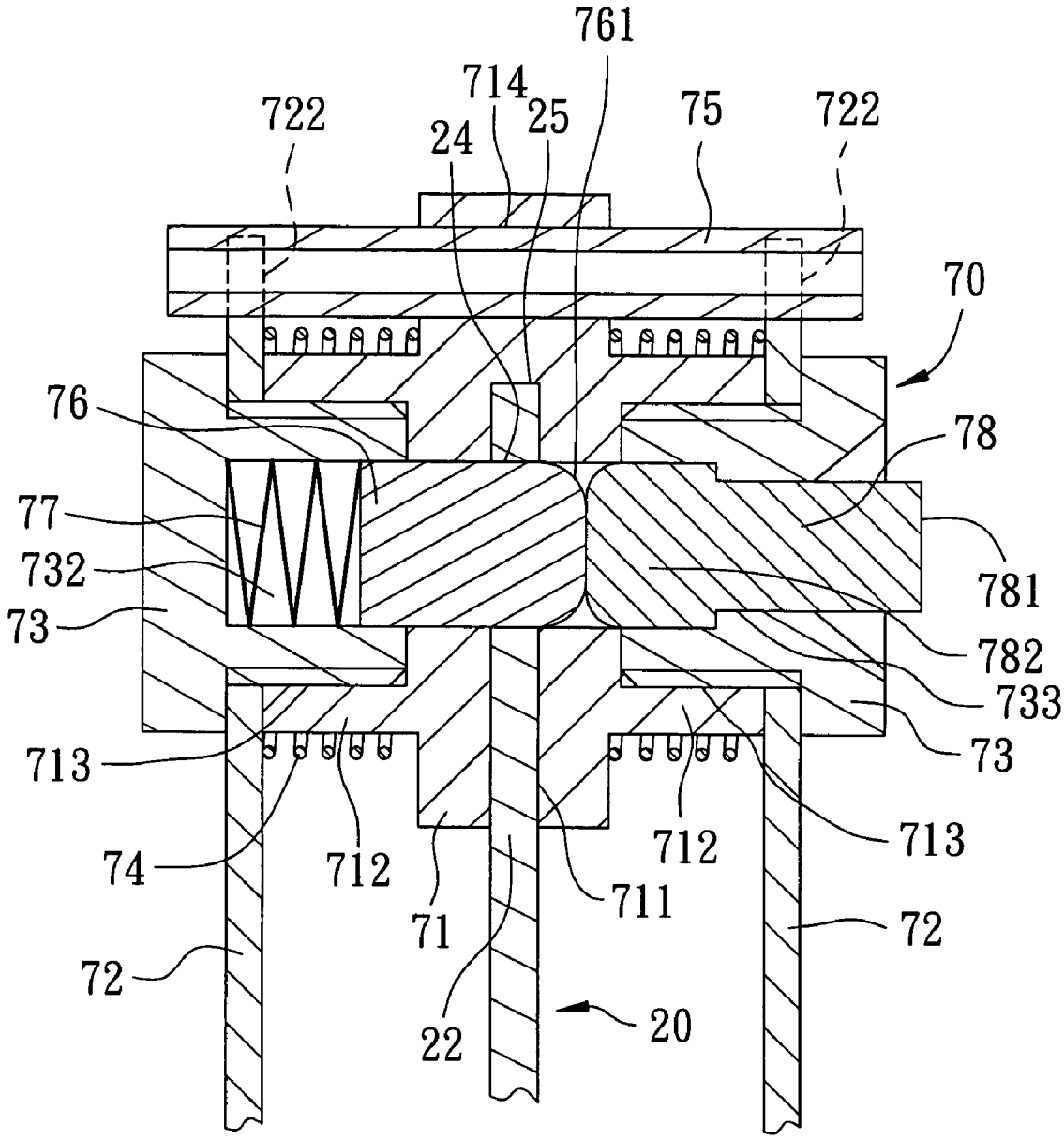
FIG. 14 is a fragmentary assembled sectional view of the preferred embodiment shown in FIG. 13, showing a retaining pin in a latched position.

Furthermore, referring to FIGS. 13 and 14, the hold-down unit 70 includes a journal body 71, two hold-down members 72, a first biasing member 74, a retaining pin 76, a second biasing member 77, and a middle push actuator 78.

The journal body 71 is disposed to ride on the retaining edge 25 of the upper end portion 22 of the supporting member 20 through a slot 711, and has two tubular journal portions 712 which are disposed at two opposite sides of the upper end portion 22 of the supporting member 20 and which respectively have receiving holes 713 that are aligned with the retaining hole 24 in the transverse direction and that are in the form of screw holes so as to threadedly engage screw bolts 73. In addition, the journal body 71 is formed with a passage hole 714 that extends in the transverse direction. A barrier shaft 75 extends through the passage hole 714, and has two ends extending outwardly thereof.

Each of the hold-down members 72 has an upper pivot end 722 which is journalled on the respective tubular journal portion 712 through a hole 721, and a lower holding end 723 which extends downwardly from the upper pivot end 722 and which is configured to be kept in sliding contact with the workpiece sawn by the cutting blade so as to stabilize the sawing operation of the sawing machine.

The first biasing member 74 is a torsion spring, and includes an abutting portion 741 abutting against the supporting member 20, two coiled spring portions 742 respectively surrounding the tubular journal portions 712, and two hooks 743 respectively abutting against the hold-down members 72 so as to bias the lower holding ends 723 of the hold-down members 72 downwardly toward the worktable. Moreover, the turning of the lower holding ends 723 is limited by abutment of the upper pivot ends 722 against the ends of the barrier shaft 75.

The retaining pin 76 is substantially rectangular in shape, and mates with the retaining hole 24 in the upper end portion 22 of the supporting member 20. The retaining pin 76 is received in the receiving hole 713 in one of the tubular journal portions 712, extends in the transverse direction, and is movable relative to the journal body 71 in the transverse direction. The second biasing member 77 is disposed in a seat hole 732 in one of the screw bolts 73. Thus, the retaining pin 76 is movable between a latched position, as shown in FIG. 14, where the retaining pin 76 extends into the retaining hole 24 so as to retain the journal body 71 on the upper end portion 22, and a released position, as shown in FIG. 15, where the retaining pin 76 is clear of the retaining hole 24 when pressed out of the retaining hole 24 in the transverse direction against the biasing action of the second biasing member 77.

Figure 15:
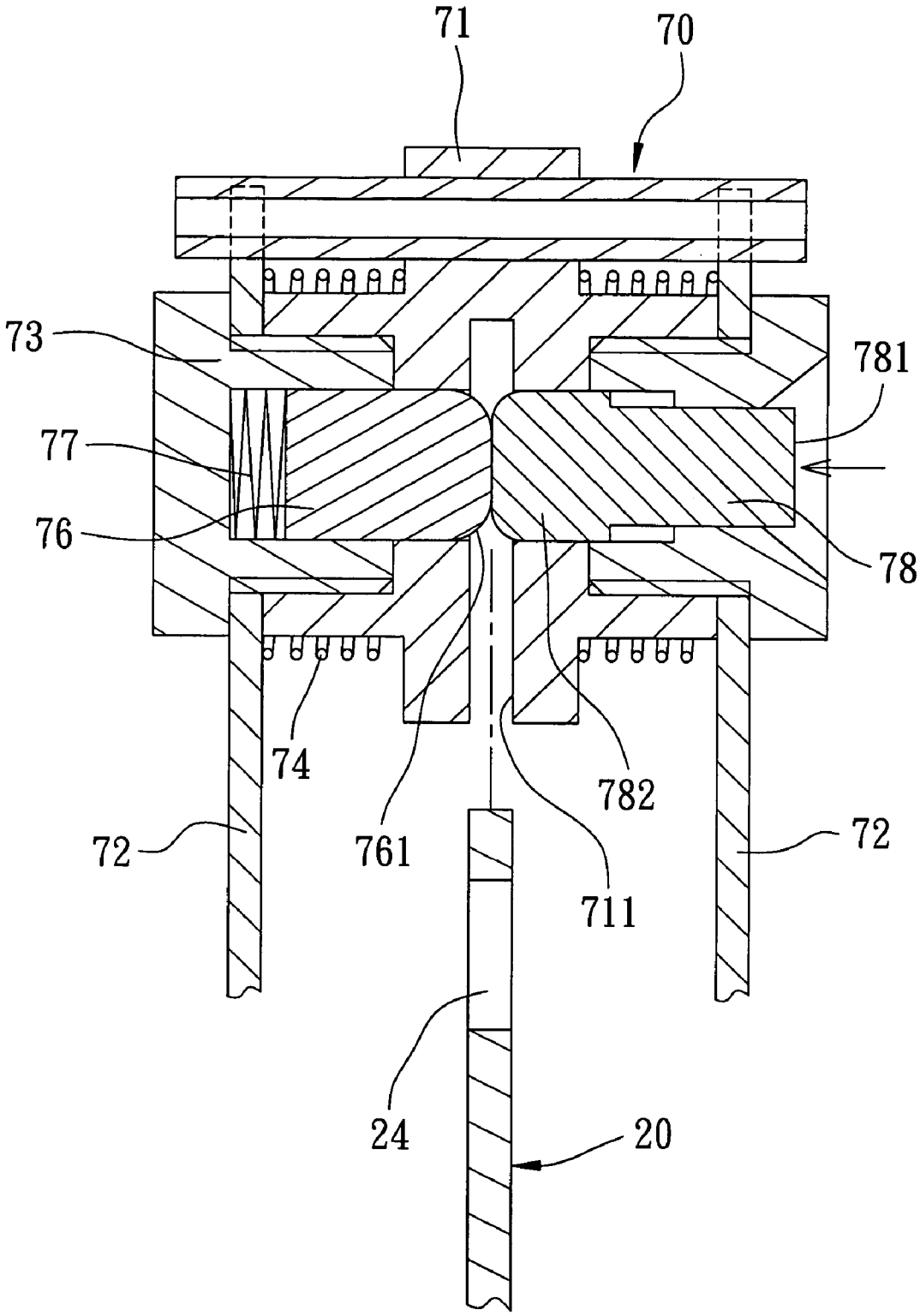
FIG. 15 is a fragmentary sectional view similar to FIG. 14, showing how two hold-down members are detached from the supporting member.
Figure 16:
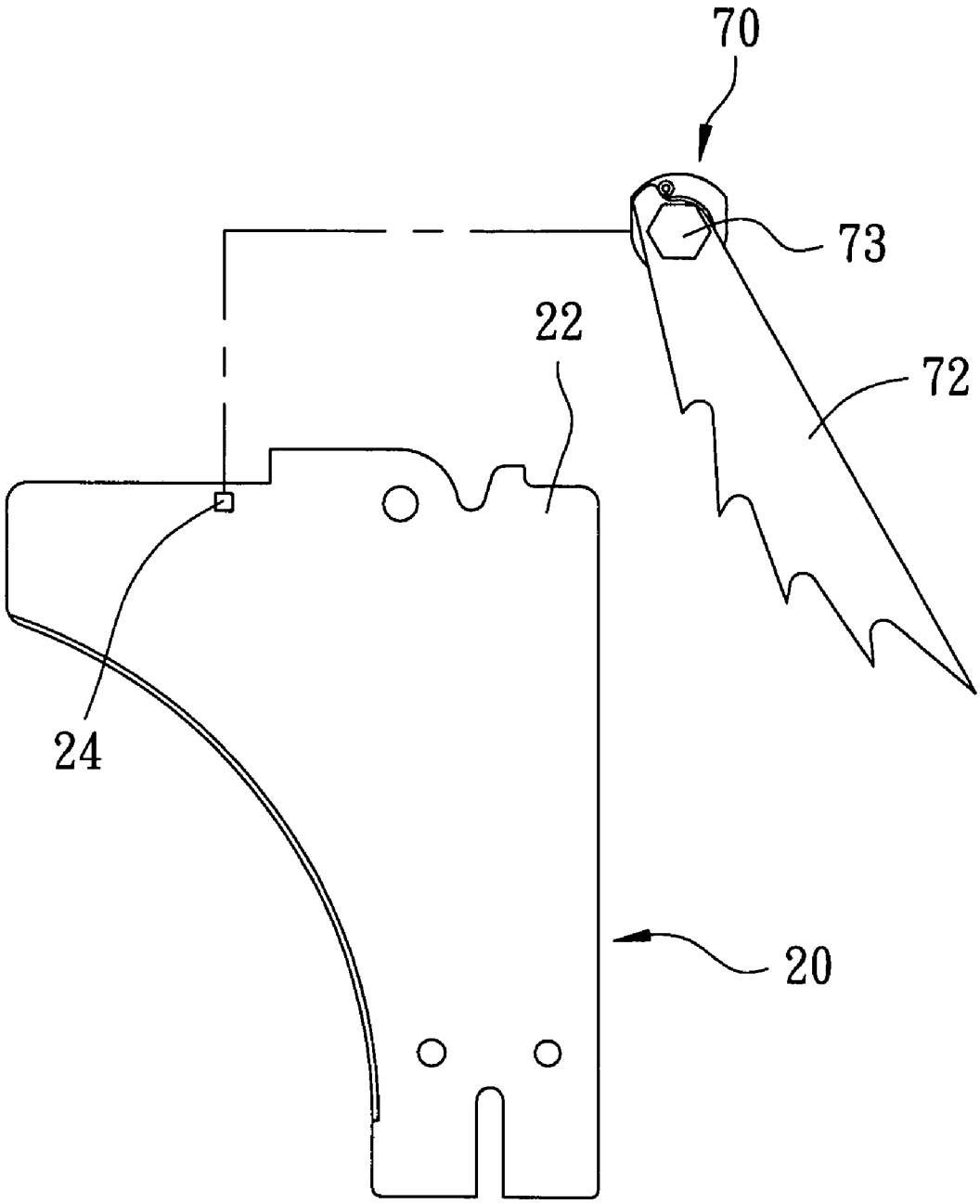
FIG. 16 is a schematic view of the preferred embodiment, showing that the hold-down members are detached from the supporting member.

The middle push actuator 78 extends through the receiving hole 713 in the other one of the tubular journal portions 712, and has an actuating end 782 extending to be in contact with an actuated end 761 of the retaining pin 76, and an operated end 781 extending out of the respective screw bolt 73 through a through hole 733 such that the operated end 781 can be operated to push the retaining pin 76 in the transverse direction against the biasing action of the second biasing member 77 so that the retaining pin 76 is clear of the retaining hole 24, thereby permitting separation of the journal body 71 from the supporting member 20, as shown in FIGS. 15 and 16.

Preferably, each of the actuated end 761 of the retaining pin 76 and the actuating end 782 of the middle push actuator 78 has a round edge so as to facilitate movement of the retaining pin 76 upwards and away from the upper end portion 22 while the actuated end 761 is kept in contact with the actuating end 782 by the biasing action of the second biasing member 77 in the released position.

As illustrated, when it is desired to replace the cutting blade of the sawing machine, the cover shield 30 and the cantilever 40 can be detached from the supporting member 20 by separating the rear pivot end 402 of the cantilever 40 from the upper end portion 22 of the supporting member 20, as shown in FIGS. 7 and 8. Alternatively, the cover shield 30 can be detached alone from the supporting member 20 by separating the shanks 611 and the screw nuts 62 from the releasing holes 421 in the front pivot end 401 of the cantilever 40, as shown in FIGS. 11 and 12. Thus, replacement of the cutting blade is convenient to conduct. Moreover, the hold-down unit 70 can be detached from the supporting member 20 by removing the journal body 71 from the retaining hole 24 in the supporting member 20.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A protective cover device adapted to be mounted on a worktable of a sawing machine on which a workpiece is fed along a working path in a longitudinal direction, comprising:

a supporting member having a lower end portion which is adapted to be secured on the worktable, and an upper end portion which is opposite to said lower end portion in an upright direction transverse to the longitudinal direction and which has a rear pivot hole extending therethrough in a transverse direction relative to both the upright direction and the longitudinal direction;

a cantilever having front and rear pivot ends opposite to each other in the longitudinal direction;

a rear journal pin extending into said rear pivot hole to pivotally secure said rear pivot end to said upper end portion such that said rear pivot end is turnable about a rear axis in the transverse direction between a lifted position where said front pivot end is remote from said upper end portion, and a working position where said front pivot end is closer to said upper end portion;

a cover shield which is configured to be adapted to cover a cutting blade of the sawing machine, and which includes front and rear ends opposite to each other in the longitudinal direction, and a middle portion interposed therebetween, said front end extending downwards to terminate at a nose edge, said middle portion having a front pivot hole which extends in the transverse direction; and a front journal pin extending into said front pivot hole and said front pivot end to pivotally secure said middle portion to said front pivot end of said cantilever such that said nose edge is brought to be in sliding contact with an upper surface of the workpiece fed along the working path by virtue of gravity when said rear pivot end is in the working position;

said rear journal pin being movable relative to said rear pivot end in the transverse direction between a latched position, where said rear journal pin pivotally secures said rear pivot end to said upper end portion by extending into said rear pivot hole, and a released position, where said rear journal pin is clear of said rear pivot hole by being withdrawn therefrom in the transverse direction;

said rear pivot end of said cantilever including left and right lugs which are spaced apart from each other in the transverse direction so as to define an accommodation space for receiving said upper end portion therein, and which respectively have left and right through holes, said rear journal pin extending through said left through hole and having an actuated end which extends into said accommodation space so as to extend through said rear pivot hole in said upper end portion to be placed in the latched position, said protective cover device further comprising:

a rear push actuator having an actuating end which confronts said actuated end, and an operated end which extends outwardly of said right through hole and which is operable to move said actuating end in the transverse direction so as to push said actuated end to be clear of said rear pivot hole to thereby move said rear journal pin to the released position; and a biasing member disposed to bias said rear journal pin to the latched position.

2. The protective cover device of claim 1, further comprising a first guiding member disposed to be secured to said left lug, said first guiding member including:

a left stem which is configured to pass through said left through hole, and which has an inserting bore extending along the rear axis to be exposed to said accommodation space so as to guide movement of said rear journal pin into said inserting bore, and a left enlarged head which extends leftwards from said left stem and outwardly of said left through hole, and which forms, in cooperation with said left stem, a left surrounding shoulder to abut against said left lug, said biasing member being disposed in said inserting bore between said left enlarged head and said rear journal pin to bias said actuated end of said rear journal pin to the latched position.

3. The protective cover device of claim 2, wherein said left stem has a left outer threaded surface that surrounds the rear axis, said protective cover device further comprising a left tightening member which threadedly engages said left outer threaded surface so as to permit said left surrounding shoulder to be brought to abut against said left lug.

4. The protective cover device of claim 3, further comprising a second guiding member disposed to be secured to said right lug, said second guiding member including:

a right stem which is disposed in and which extends rightwards and outwardly of said right through hole, and a right enlarged head which extends leftwards from said right stem into said accommodation space, and which forms, in cooperation with said right stem, a right surrounding shoulder to abut against said right lug, said right enlarged head having an guiding bore which accommodates said actuating end, and which extends along the rear axis to be communicated with said inserting bore so as to permit said actuating end to move along the rear axis to push said actuated end clear of said rear pivot hole, said operated end of said rear push actuator being disposed to extend through said right stem so as to extend rightwards and outwardly of said right through hole.

5. The protective cover device of claim 4, wherein said right stem has a right outer threaded surface that surrounds the rear axis, said protective cover device further comprising a right tightening member which threadedly engages said right outer threaded surface so as to permit said right surrounding shoulder to be brought to abut against said right lug.

6. The protective cover device of claim 1, wherein each of said actuated end of said rear journal pin and said actuating end of said rear push actuator has a round edge so as to facilitate movement of said rear pivot end upwards and away from said upper end portion while said actuated end of said rear journal pin is kept in contact with said actuating end by the biasing action of said biasing member in the released position.

7. A protective cover device adapted to be mounted on a worktable of a sawing machine on which a workpiece is fed along a working path in a longitudinal direction, comprising:

a supporting member having a lower end portion which is adapted to be secured on the worktable, and an upper end portion which is opposite to said lower end portion in an upright direction transverse to the longitudinal direction and which has a rear pivot hole extending therethrough in a transverse direction relative to both the upright direction and the longitudinal direction;

a cantilever having front and rear pivot ends opposite to each other in the longitudinal direction;

a rear journal pin extending into said rear pivot hole to pivotally secure said rear pivot end to said upper end portion such that said rear pivot end is turnable about a rear axis in the transverse direction between a lifted position where said front pivot end is remote from said upper end portion, and a working position where said front pivot end is closer to said upper end portion;

a cover shield which is configured to be adapted to cover a cutting blade of the sawing machine, and which includes front and rear ends opposite to each other in the longitudinal direction, and a middle portion interposed therebetween, said front end extending downwards to terminate at a nose edge, said middle portion having a front pivot hole which extends in the transverse direction; and a front journal pin extending into said front pivot hole and said front pivot end to pivotally secure said middle portion to said front pivot end of said cantilever such that said nose edge is brought to be in sliding contact with an upper surface of the workpiece fed along the working path by virtue of gravity when said rear pivot end is in the working position;

said front journal pin being movable relative to front pivot end in the transverse direction between a latched position, where said front journal pin pivotally secures said front pivot end to said middle portion by extending into said front pivot hole, and a released position, where said front journal pin is clear of said front pivot end by being withdrawn therefrom in the transverse direction;

said cover shield including two side plates spaced apart from each other in the transverse direction to define a mounting space for receiving said cantilever therein;

said front pivot hole extending through said side plates, said front pivot end of said cantilever including two lugs which are spaced apart from each other in the transverse direction and each of which has a through hole extending in the transverse direction, and a releasing hole extending in the upright direction and communicated with said through hole to form an integral opening;

said front journal pin including two journal shafts, each of which has a shank extending through said front pivot hole and terminating at a connecting end that is inserted into said through hole in a respective one of said lugs so as to be placed in the latched position, said shank having an operated end opposite to said connecting end and disposed outwardly of a respective one of said side plates;

said protective cover device further comprising two biasing members, each of which is disposed to bias a respective one of said journal shafts to the latched position, such that when said operated end is pressed against biasing action of a respective one of said biasing members, said connecting end is withdrawn to be clear of said through hole so as to be moved to the released position, thereby permitting lifting said shanks and said cover shield away from said lugs in the upright direction.

8. The protective cover device of claim 7, wherein said front journal pin includes two screw nuts, each of which is threadedly engaged with said connecting end of said shank of a respective one of said journal shafts against the biasing action of a respective one of said biasing members such that a respective one of said screw nuts is brought to abut against a respective one of said side plates so as to retain said shank of the respective one of said journal shafts in said through hole in the respective one of said lugs in the latched position.

9. A protective cover device adapted to be mounted on a worktable of a sawing machine on which a workpiece is fed along a working path in a longitudinal direction, comprising:

a supporting member having a lower end portion which is adapted to be secured on the worktable, and an upper end portion which is opposite to said lower end portion in an upright direction transverse to the longitudinal direction and which has a rear pivot hole extending therethrough in a transverse direction relative to both the upright direction and the longitudinal direction;

a cantilever having front and rear pivot ends opposite to each other in the longitudinal direction;

a rear journal pin extending into said rear pivot hole to pivotally secure said rear pivot end to said upper end portion such that said rear pivot end is turnable about a rear axis in the transverse direction between a lifted position where said front pivot end is remote from said upper end portion, and a working position where said front pivot end is closer to said upper end portion;

a cover shield which is configured to be adapted to cover a cutting blade of the sawing machine, and which includes front and rear ends opposite to each other in the longitudinal direction, and a middle portion interposed therebetween, said front end extending downwards to terminate at a nose edge, said middle portion having a front pivot hole which extends in the transverse direction; and a front journal pin extending into said front pivot hole and said front pivot end to pivotally secure said middle portion to said front pivot end of said cantilever such that said nose edge is brought to be in sliding contact with an upper surface of the workpiece fed along the working path by virtue of gravity when said rear pivot end is in the working position;

at least one of said rear and front journal pins being movable relative to a corresponding one of said rear and front pivot ends in the transverse direction between a latched position, where a respective one of said rear and front journal pins pivotally secures a corresponding one of said rear and front pivot ends to a corresponding one of said upper end portion and said middle portion by extending into a corresponding one of said rear and front pivot holes, and a released position, where the respective one of said rear and front journal pins is clear of the corresponding one of said rear pivot hole and said front pivot end by being withdrawn therefrom in the transverse direction;

said upper end portion having a retaining hole extending therethrough in the transverse direction;

said protective cover device further comprising:

a journal body which is disposed to ride on said upper end portion and which has two tubular journal portions that are disposed at two opposite sides of said upper end portion and that respectively have two receiving holes aligned with said retaining hole in the transverse direction;

two hold-down members, each having an upper pivot end which is journalled on a respective one of said tubular journal portions, and a lower holding end which extends downwardly from said upper pivot end and which is configured such that said lower holding end is kept in sliding contact with the workpiece in a cutting operation; and a retaining pin which is received in one of said receiving holes, which extends in the transverse direction, and which is movable relative to said journal body in the transverse direction between a latched position, where said retaining pin extends into said retaining hole so as to retain said journal body on said upper end portion, and a released position, where said retaining pin is clear of said retaining hole by being withdrawn therefrom in the transverse direction.

10. The protective cover device of claim 9, further comprising a first biasing member disposed to respectively bias said lower holding ends of said hold-down members downwardly toward the worktable.

11. The protective cover device of claim 10, further comprising:

a middle push actuator extending through the other one of said receiving holes towards said one of said receiving holes to be operated to push said retaining pin in the transverse direction so that said retaining pin is clear of said retaining hole, thereby moving said retaining pin to the released position; and a second biasing member disposed to bias said retaining pin to the latched position.

* * * * *